US007003448B1

(12) United States Patent
Lauber et al.

(10) Patent No.: US 7,003,448 B1
(45) Date of Patent: Feb. 21, 2006

(54) METHOD AND DEVICE FOR ERROR CONCEALMENT IN AN ENCODED AUDIO-SIGNAL AND METHOD AND DEVICE FOR DECODING AN ENCODED AUDIO SIGNAL

(75) Inventors: Pierre Lauber, Nuremberg (DE); Martin Dietz, Nuremberg (DE); Juergen Herre, Buckenhof (DE); Reinhold Boehm, Nuremberg (DE); Ralph Sperschneider, Erlangen (DE); Daniel Homm, Erlangen (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 0 days.

(21) Appl. No.: 09/980,534

(22) PCT Filed: Apr. 12, 2000

(86) PCT No.: PCT/EP00/03294

§ 371 (c)(1),
(2), (4) Date: Oct. 31, 2002

(87) PCT Pub. No.: WO00/68934

PCT Pub. Date: Nov. 16, 2000

(30) Foreign Application Priority Data

May 7, 1999 (DE) ..... 199 21 122

(51) Int. Cl.
*G10L 19/00* (2006.01)

(52) U.S. Cl. ..... 704/200.1

(58) Field of Classification Search ..... 704/200.1, 704/203, 219, 501, 502, 503, 504
See application file for complete search history.

(56) References Cited

U.S. PATENT DOCUMENTS 5,581,651 A 12/1996 Ishino et al. ..... 395/2.14
5,673,363 A * 9/1997 Jeon et al. ..... 704/270

(Continued)

FOREIGN PATENT DOCUMENTS

DE 40 34 017 A1 4/1992

(Continued)

OTHER PUBLICATIONS

Tribolet et al., "Frequency Domain Coding of Speech," IEEE Transactions On Acoustics, Speech, And Signal Processing, IEEE, vol. ASSP-27 (No. 5), p. 512-530 (Oct. 1979).

(Continued)

*Primary Examiner*—Tālivaldis Ivars Šmits
*Assistant Examiner*—Abdelali Serrou
(74) *Attorney, Agent, or Firm*—Michael A. Glenn; Glenn Patent Group

(57) ABSTRACT

In a method for concealing an error in an encoded audio signal a set of spectral coefficients is subdivided into at least two sub-bands (14), whereupon the sub-bands are subjected to a re-verse transform (16). A specific prediction is performed (18) for each quasi time signal of a sub-band to obtain an estimated temporal representation for a sub-band of a set of spectral coefficients following the current set. A forward transform (20) of the time signal of each sub-band provides estimated spectral coefficients which can be used (28) instead of erroneous spectral coefficients of a following set of spectral coefficients, e.g. in order to conceal transmission errors. Transforming at the sub-band level provides independence from transform characteristics such as block length, window type and MDCT algorithm while at the same time preserving spectral processing for error concealment. Thus the spectral characteristics of audio signals can also be taken into account during error concealment.

13 Claims, 7 Drawing Sheets

U.S. PATENT DOCUMENTS

| | | | | |
|---|---|---|---|---|
| 5,752,225 | A * | 5/1998 | Fielder | 704/229 |
| 5,781,888 | A * | 7/1998 | Herre | 704/200.1 |
| 5,852,805 | A | 12/1998 | Hiratsuka et al. | 704/500 |
| 6,418,408 | B1 * | 7/2002 | Udaya Bhaskar et al. | 704/219 |

FOREIGN PATENT DOCUMENTS

| | | |
|---|---|---|
| DE | 197 35 675 A1 | 12/1998 |
| EP | 0 718 982 A2 | 12/1998 |
| JP | 03-245370 | 10/1991 |

OTHER PUBLICATIONS

Maekivirta et al., "Error Performance and Error Concealment Strategies for MPEG Audio Coding," Australian Telecommunication Networks & Applications Conference (Melbourne, Australlia), p. 505-510 (Dec. 5-7, 1994).

Juergen Herre, "Fehlerverschleierung bei spektral codierten Audiosignalen," (Erlangen, Germany), p. 1-160 (1995).

Bosi et al., "ISO/IEC MPEG-2 Advanced Audio Coding," 101 st Convention of the Audio Engineering Society (Los Angeles, CA), p. 789-812 (Nov. 8-11, 1996).

Widrow et al., "Adaptive Signal Processing", Prentice-Hall, Inc. (Englewood Cliffs, NJ), cover pages and pages vii-xii of Table Of Contents (1985).

* cited by examiner

METHOD AND DEVICE FOR ERROR CONCEALMENT IN AN ENCODED AUDIO-SIGNAL AND METHOD AND DEVICE FOR DECODING AN ENCODED AUDIO SIGNAL

FIELD OF THE INVENTION

The present invention relates to the encoding and decoding of audio signals and in particular to error concealment in digital encoded audio signals.

BACKGROUND OF THE INVENTION AND PRIOR ART

As a result of the increasingly widespread use of modern audio encoders and the corresponding audio decoders, which operate according to one of the MPEG standards, the transmission of encoded audio signals over radio networks or line-based net-works such as the internet has already become very important. The transmission channel involved in the transmission of encoded audio signals by means of digital radio or over line-based networks is not ideal, which can result in encoded audio signals being adversely affected during the transmission. The decoder is therefore confronted with the question of how to deal with transmission errors, i.e. how these transmission errors are to be "concealed". The objective of error concealment is to manipulate transmission errors in such a way as to improve the subjective auditory sensation arising from such an error-afflicted decoded audio signal.

Many error concealment methods are already known. The simplest type of error concealment is that of "muting". When a decoder recognizes that data are missing or are erroneous, it interrupts the reproduction. The missing data are thus replaced by a zero signal. In this way the decoder is prevented from issuing sounds which, due to a transmission error, would be found too loud or disconcerting. Because of psychoacoustic effects, however, the resulting sudden fall in the signal energy and its sudden rise when the decoder issues error-free data again is found disconcerting.

Another known method which avoids the sudden fall and subsequent rise in the signal energy is that of data repetition. If e.g. one or more blocks of audio data are missing, part of the data last transmitted are repeated in a loop until error-free, i.e. intact, audio data are available again. This method produces disturbing artefacts, however. If only short parts of the audio signal are repeated, the repeated signal sounds mechanical whatever the original signal may have been like, having a basic frequency equal to the repetition frequency. If longer parts are repeated, certain echo effects arise which are also found disturbing.

In block-oriented transform encoders/decoders that employ a spectral representation of a temporal audio signal, the possibility would also exist of performing a spectral value prediction in the case of erroneous audio data. If it is established that spectral values in a block are erroneous, these spectral values can be predicted, i.e. estimated, on the basis of the spectral values of a preceding frame or a number of preceding frames. The predicted spectral values correspond within certain limits to the erroneous spectral values if the audio signal is relatively steady, i.e. if the audio signal is not subject to any very fast changes in the signal envelope. If e.g. a method employing the MPEG AAC standard (ISO/IEC 13818-7 MPEG-2 Advanced Audio Coding)] is considered, a normal block or frame of encoded audio data has 1024 spectral values. For the method of spectral value prediction 1024 parallel operating predictors will therefore be needed in the decoder so that, if a complete frame is lost, all the spectral values can be predicted.

A disadvantage of this method is the relatively high computational effort, which makes a real-time decoding of a received multimedia or audio data signal impossible at present.

A further important disadvantage of this method results from the transform algorithm, namely the modified discrete cosine transform (MDCT)], which is used. It is generally known that the MDCT algorithm does not provide an ideal Fourier spectrum but a "spectrum" which deviates from an ideal Fourier spectrum. Investigations have shown that a sine time function e.g., which has a Fourier spectrum with a single spectral line at the frequency of the sine function, has an MDCT "spectrum" which, while it has a dominant spectral coefficient at the frequency of the sine function, also has in addition further spectral coefficients at other frequency values. Furthermore, the height of an MDCT "spectrum" of a sine function does not remain the same from one frame to another but varies from frame to frame. Another fact is that the MDCT transform is not strictly energy conserving. What can be stated, therefore, is that, while the MDCT transform works exactly in conjunction with an inverse MDCT transform, the MDCT spectrum differs considerably from a Fourier spectrum. A spectral value prediction of MDCT spectral coefficients has thus shown itself to be inadequate when high precision is required.

A further disadvantage of spectral value prediction, particularly in connection with modern audio coding methods, is that modern audio coding methods use different window lengths or window shapes. To prevent the quantization noise arising from the quantization of the MDCT spectral coefficients being "smeared" over a long block, i.e. the occurrence of pre-echoes, when there are rapid changes (transients or "attacks")] in the audio signal to be encoded, modern transform encoders use short windows for transient audio signals, i.e. audio signals with "attacks", to increase the temporal resolution at the expense of the frequency resolution. This means, however, that for a spectral value prediction both the window length and the window shape (in addition there are transition windows to initiate windowing from short to long blocks and vice versa)] must be constantly taken into account, which also increases the complexity of the spectral value prediction and would greatly affect the computational efficiency.

DE 40 34 017 A1 relates to a method for detecting errors in the transmission of frequency coded digital signals. From the frequency coefficients or previous and, in some cases, future frames, an error function is formed on the basis of which the occurrence of an error can be detected. An erroneous frequency coefficient is no longer included in the evaluation of subsequent frames.

DE 197 35 675 A1 discloses a method for concealing errors in an audio data stream. The spectral energy of a subgroup of intact audio data is calculated. After producing a pattern for substitute data using the spectral energy calculated for the subgroup of intact audio data, substitute data for erroneous or missing audio data corresponding to the subgroup are generated according to the pattern.

SUMMARY OF THE INVENTION

It is the object of the present invention to provide precise and flexible error concealment for audio signals which can be implemented with limited computational effort and an error-tolerant and flexible decoding of audio signals.

In accordance with a first aspect of the present invention, this object is achieved by a method for concealing an error in an encoded audio signal, where the encoded audio signal has successive sets of spectral coefficients, where a set of spectral coefficients is a spectral representation for a set of audio sampled values, comprising the following steps: subdividing a current set of spectral coefficients into at least two sub-bands with different frequency ranges, where one sub-band of the at least two sub-bands has at least two spectral coefficients; reverse transforming the spectral coefficients of the one sub-band to obtain a temporal representation of the at least two spectral coefficients of the one sub-band; performing a prediction using the temporal representation of the at least two spectral coefficients of the one sub-band to obtain an estimated temporal representation for a sub-band of a set following the current set, where the sub-band of the following set has the same frequency range as the sub-band of the current set; forward transforming the estimated temporal representation to obtain at least two estimated spectral coefficients for the sub-band of the following set; determining whether a spectral coefficient of the sub-band of the following set is erroneous; and as reaction to the step of determining, if there is an erroneous spectral coefficient, using an estimated spectral coefficient instead of an erroneous spec-tral coefficient of the following set so as to conceal the erroneous spectral coefficient of the following set.

In accordance with a second aspect of the present invention, this object is achieved by a method for decoding an encoded audio signal which comprises successive sets of spectral coefficients, wherein a set of spectral coefficients is a spectral representation for a set of audio sampled values: receiving a current set of spectral coefficients; subdividing a current set of spectral coefficients into at least two sub-bands with different frequency ranges, where one sub-band of the at least two sub-bands has at least two spectral coefficients; reverse transforming the spectral coefficients of the one sub-band to obtain a temporal representation of the at least two spectral coefficients of the one sub-band; performing a prediction using the temporal representation of the at least two spectral coefficients of the one sub-band to obtain an estimated temporal representation for a sub-band of a set following the cur-rent set, where the sub-band of the following set has the same frequency range as the sub-band of the current set; forward transforming the estimated temporal representation to obtain at least two estimated spectral coefficients for the sub-band of the following set; receiving a following set of spectral coefficients and subdividing the following set into sub-bands which cover the same frequency range as the sub-bands of the current set; determining whether a spectral coefficient of the sub-band of the following set is erroneous; as reaction to the step of determining, if there is an erroneous spectral coefficient, using an estimated spectral coefficient instead of an erroneous spectral coefficient of the following set so as to conceal the erroneous spectral coefficient of the following set; and processing the following set using the estimated spectral coefficient used in the step of using to obtain the following set of audio sampled values.

In accordance with a third aspect of the present invention, this object is achieved by a device for concealing an error in an encoded audio signal, where the encoded audio signal has successive sets of spectral coefficients, where a set of spec-tral coefficients is a spectral representation for a set of audio sampled values, comprising: a unit for subdividing a current set of spectral coefficients into at least two sub-bands with different frequency ranges, where one sub-band of the at least two sub-bands has at least two spectral coefficients; a unit for reverse transforming the spectral coefficients of the one sub-band to obtain a temporal representation of the at least two spectral coefficients of the one sub-band; a unit for performing a prediction using the temporal representation of the at least two spectral coefficients of the one sub-band to obtain an estimated temporal representation for a sub-band of a set following the current set, where the sub-band of the following set has the same frequency range as the sub-band of the current set; a unit for forward transforming the estimated temporal representation to obtain at least two estimated spectral coefficients for the sub-band of the following set; a unit for determining whether a spectral coefficient of the sub-band of the following set is erroneous; and a unit for using an estimated spectral coefficient instead of an erroneous spectral coefficient of the following set so as to conceal the erroneous spectral coefficient of the following set.

In accordance with a fourth aspect of the present invention, this object is achieved by a device for decoding an encoded audio signal which comprises successive sets of spectral coefficients, where a set of spectral coefficients is a spectral representation for a set of audio sampled values, comprising:

a unit for receiving a current set of spectral coefficients; a unit for subdividing a current set of spectral coefficients into at least two sub-bands with different frequency ranges, where one sub-band of the at least two sub-bands has at least two spectral coefficients; a unit for reverse transforming the spectral coefficients of the one sub-band to obtain a temporal representation of the at least two spectral coefficients of the one sub-band; a unit for performing a prediction using the temporal representation of the at least two spectral coefficients of the one sub-band to obtain an estimated temporal representation for a sub-band of a set following the current set, where the sub-band of the following set has the same frequency range as the sub-band of the current set; a unit for forward transforming the estimated temporal representation to obtain at least two estimated spectral coefficients for the sub-band of the following set; a unit for receiving a following set of spectral coefficients and for subdividing the following set into sub-bands which cover the same frequency range as the sub-bands of the current set; a unit for determining whether a spectral coefficient of the sub-band of the following set is erroneous; a unit for using an estimated spectral coefficient instead of an erroneous spectral coefficient of the following set so as to conceal the erroneous spectral coefficient of the following set; and a unit for processing the following set using the estimated spectral coefficient to obtain the following set of audio sampled values.

The present invention is based on the finding that the disadvantages of the spectral value prediction, which reside in the dependence on the transform algorithm which is used and in the dependence on the window shape and block length, can be avoided by performing error concealment by means of a prediction which functions in the "quasi" time domain. To this end a set of spectral values which preferably corresponds to a long block or a number of short blocks is subdivided into sub-bands. A sub-band of the current set of spectral coefficients can then undergo a reverse transform so as to obtain a time signal corresponding to the spectral coefficients of the sub-band. To generate estimated values for a subsequent set of spectral coefficients, a prediction is performed on the basis of the time signal of this sub-band.

It should be noted that this prediction takes place in the quasi time domain since the temporal signal on the basis of which the prediction is performed is simply the time signal of one sub-band of the encoded audio signal and not the time signal of the whole spectrum of the audio signal. The time signal generated by prediction is subjected to a forward transform to obtain estimated, i.e. predicted, spectral coefficients for the sub-band of the following set of spectral coefficients. If it now established that there are one or more erroneous spec-tral coefficients in the following set of spectral coefficients, the erroneous spectral coefficients can be replaced by the estimated, i.e. predicted, spectral coefficients.

Compared to the pure spectral value prediction, the method according to the present invention for error concealment requires less computational effort since, as the spectral coefficients have been grouped together, predictions now have to be performed only for each sub-band and no longer for each spectral coefficient. Furthermore, the method according to the present invention provides a high degree of flexibility since the characteristics of the signals to be processed can be taken into account.

The noise substitution according to the present invention works particularly well for tonal signals. It has been discovered, however, that tonal signal portions are more likely to appear in the lower-frequency range of the spectrum of an audio signal, while the higher-frequency signal portions are more likely to be unsteady, i.e. noisy. In terms of the pre-sent description, "noisy signal portions" are signal portions which are far from steady. These noisy signal portions do not have to represent noise in the classical sense, however, but simply rapidly changing user signals.

To enable the computational effort to be reduced still further, it is possible with the present invention to subject only the lower-frequency signal portions to a prediction whereas higher-frequency signal portions are not processed at all. In other words, it is possible to subject only the lowest/lower sub-band(s)] to a reverse transform, a prediction and a forward transform.

This characteristic of the present invention, in contrast to a complete transforming of the whole audio signal into the time domain and a prediction of the whole temporal audio signal from block to block using a so-called "long-term" predictor, constitutes a considerable advantage, since according to the present invention the advantages of prediction in the time domain are combined with the advantages of spectral decomposition.

Only with spectral decomposition is it possible to take account of audio signal characteristics which depend on the frequency. The number of sub-bands generated from the subdivision of the set of spectral coefficients is arbitrary. If only two sub-bands are chosen, the advantage of considering the tonality already manifests itself in the lower frequency range of the audio signal. If on the other hand many sub-bands are chosen, the predictor in the quasi time domain will have a relatively short length such that its delay doesn't become too large. Since the individual sub-bands are preferably processed in parallel, an embodiment of the present invention using a hard-wired integrated circuit would require a plurality of predictor circuits in parallel.

If the present invention is employed in connection with a transform encoder which uses different block lengths, the advantage results that the predictor itself is independent of block length and window shape. In addition, due to the reverse transform, the dependence on the transform algorithm used, explained above in relation to the MDCT, is eliminated. Furthermore, the concept according to the present invention for error concealment furnishes estimated spectral coefficients which, due to the reverse transform, the prediction in the time domain and the forward transform, have the right phase, i.e. there are no phase jumps in the time signal resulting from a predicted spectral coefficient in relation to a time signal of a preceding intact set of spectral coefficients. As a result tonal signals can be substituted for erroneous or missing signal portions so well that a normal listener does not even realize in most cases that an error has occurred.

Finally, the method according to the present invention is particularly suited for combination with an error concealment technique described in DE 197 35 675 A1, which is suitable for the substitution of noisy signal portions. If tonal signal portions of a missing block are concealed by means of the method according to the present invention, and if noisy signal portions are combined by means of the known method which has just been cited, which is based on an energy similarity between substituted data and intact data, completely missing blocks can be concealed to such an extent as to be practically inaudible for a normal listener.

BRIEF DESCRIPTION OF THE DRAWINGS

Preferred embodiments of the present invention are described in detail below making reference to the enclosed drawings, in which.

DETAILED DESCRIPTION OF PREFERRED EMBODIMENTS

Figure 1:
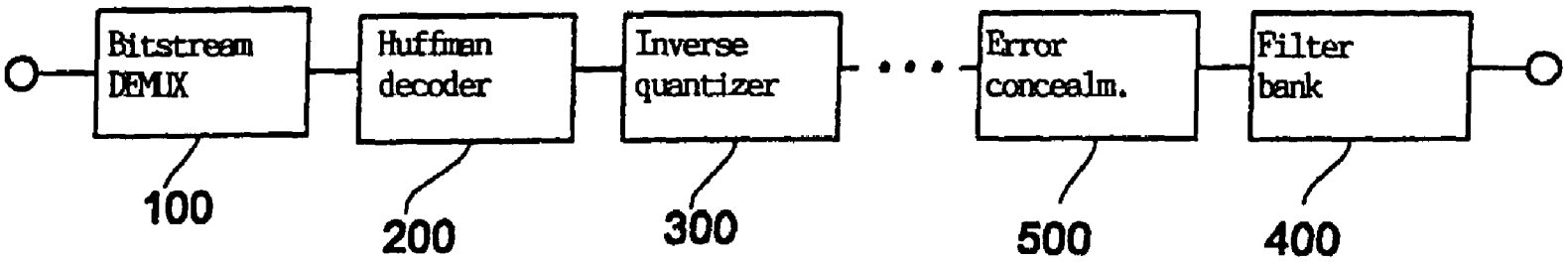
FIG. 1 shows a decoder having an error concealment unit according to the present invention.

FIG. 1 shows a block diagram of a decoder according to a preferred embodiment of the present invention. The decoder block diagram shown in FIG. 1 corresponds essentially to the MPEG-2 AAC decoder as defined in the standard MPEG-2 AAC 13818-7. The encoded audio signal is first fed into a bit stream demultiplexer 100 in order to separate spectral data and side information. The Huffman coded spectral coefficients are then fed into a Huffman decoder 200 so as to obtain quantized spectral values from the Huffman code words. The quantized spectral values are then fed into an inverse quantizer 300 and the respective scale factor bands are then multiplied by appropriate scale factors. The decoder according to the present invention can incorporate a plurality of additional functional units following the inverse quantizer 300, e.g. a middle/side stage, a predictor stage, a TNS stage, etc., as specified in the standard.

According to a preferred embodiment of the present invention the decoder includes an error concealment unit 500 which immediately precedes a synthesis filter bank 400 and which functions according to the present invention and which ensures that the effects of transmission errors in the encoded audio signal fed into the bit stream demultiplexer 100 can be mitigated or made completely inaudible. In other words, the error concealment unit 500 ensures that transmission errors are concealed, i.e. that they are not or are only faintly audible in a temporal audio signal at the output of the synthesis filter bank.

Figure 2:
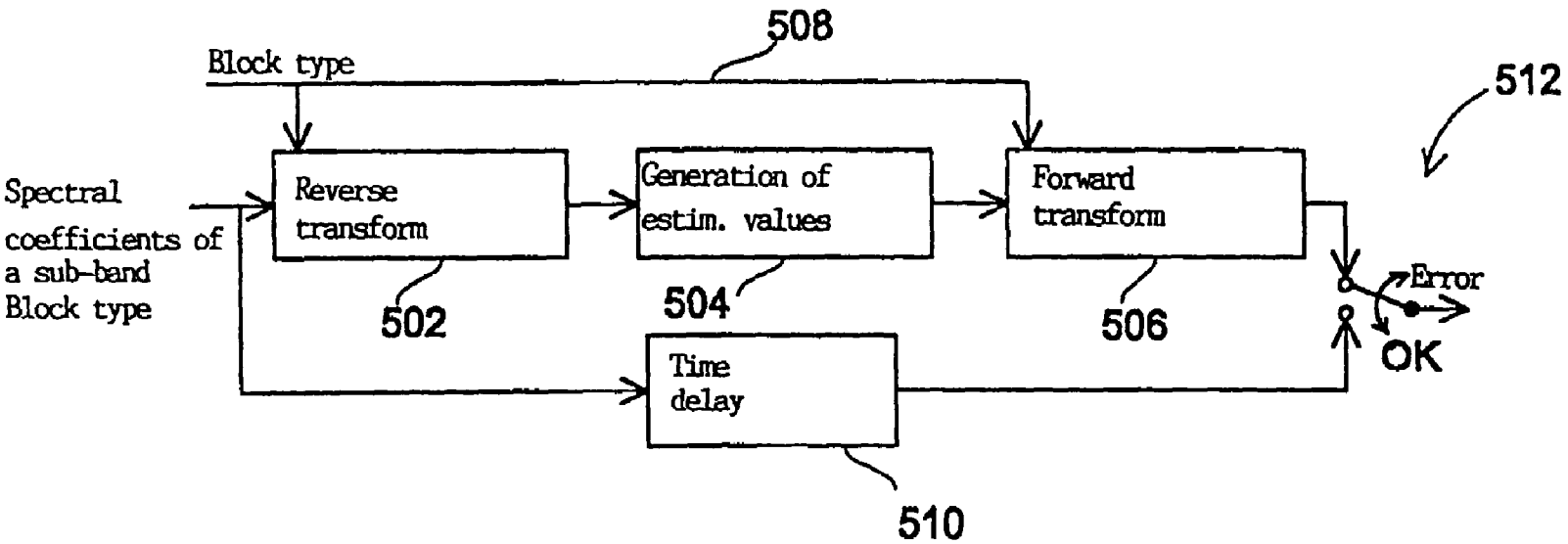
FIG. 2 shows a detailed block diagram of the error concealment unit of FIG. 1.

FIG. 2 shows a general block diagram of the error concealment unit 500. This includes a reverse transform unit 502, a unit 504 for generating estimated values and a forward transform unit 506. Both the reverse transform unit 502 and the forward transform unit 506 can be controlled according to the current block type via a block type line 508. The error concealment unit 500 also includes a parallel branch which enables the spectral coefficients on the input side to be routed directly from the input to the output bypassing the reverse transform unit 502, the unit for generating estimated values 504 and the forward transform unit 506. This parallel branch contains a time delay stage 510 so as to ensure that estimated spectral coefficients for a subsequent block which appear behind the forward transform unit 506 arrive at an error selection unit 512 simultaneously with "real", possibly erroneous spectral coefficients for the subsequent block, so that it is possible to replace any erroneous spectral coefficients in the real spectral coefficients for the subsequent block by estimated spectral coefficients for the subsequent block. This spectral value replacement is represented in FIG. 2 by a switch symbol 512. It should be noted that the error replacement unit 512 can operate on a spectral value level, or on a block or set level. Depending on the requirements, it can also operate on the sub-band level. The subsequent set of spectral coefficients, wherein any originally erroneous spectral coefficients have been replaced by estimated spectral coefficients, i.e. wherein errors have been concealed, thus appears at the output of the error replacement unit 512.

It should be pointed out here that the block diagram shown in FIG. 2 represents only a part of the error concealment unit 500. This representation has however been chosen for reasons of clarity. As will be described in more detail in FIG. 5 with reference to a preferred embodiment of the present invention, the circuit shown in FIG. 2 is preceded by a unit for subdividing into sub-bands. As a counterpart thereto, the error replacement unit 512 is followed by a unit for cancelling the subdivision into sub-bands so that the filter bank 400 (FIG. 1)] receives a "normal" set of spectral coefficients without noticing anything about the preceding error concealment. The error concealment unit 500 (FIG. 1)] thus includes a plurality of the circuits described with reference to FIG. 2, namely one circuit per sub-band. The parallel circuits are connected on the input side by the unit for subdividing and on the output side by the unit for cancelling the subdivision, as will be described in detail later.

It has already been pointed out that modern transform encoders use short windows so as to increase the temporal resolution in the event of transients in an audio signal which is to be encoded. Here it is usually the case that the number of temporal sampled values or the number of spectral coefficients in a long window or block is an integral multiple of the number of temporal sampled values or the number of spectral coefficients in a short window or block. An advantage of the present invention is that the unit 504 for generating estimated values can operate independently of the transform, the block length and the window type which are used. Both the reverse transform unit 502 and the forward transform unit 506 are therefore con-trolled according to the block type so that the same number of temporal scanned values is always presented to or emerges from the unit 504 for generating estimated values.

Figure 7:
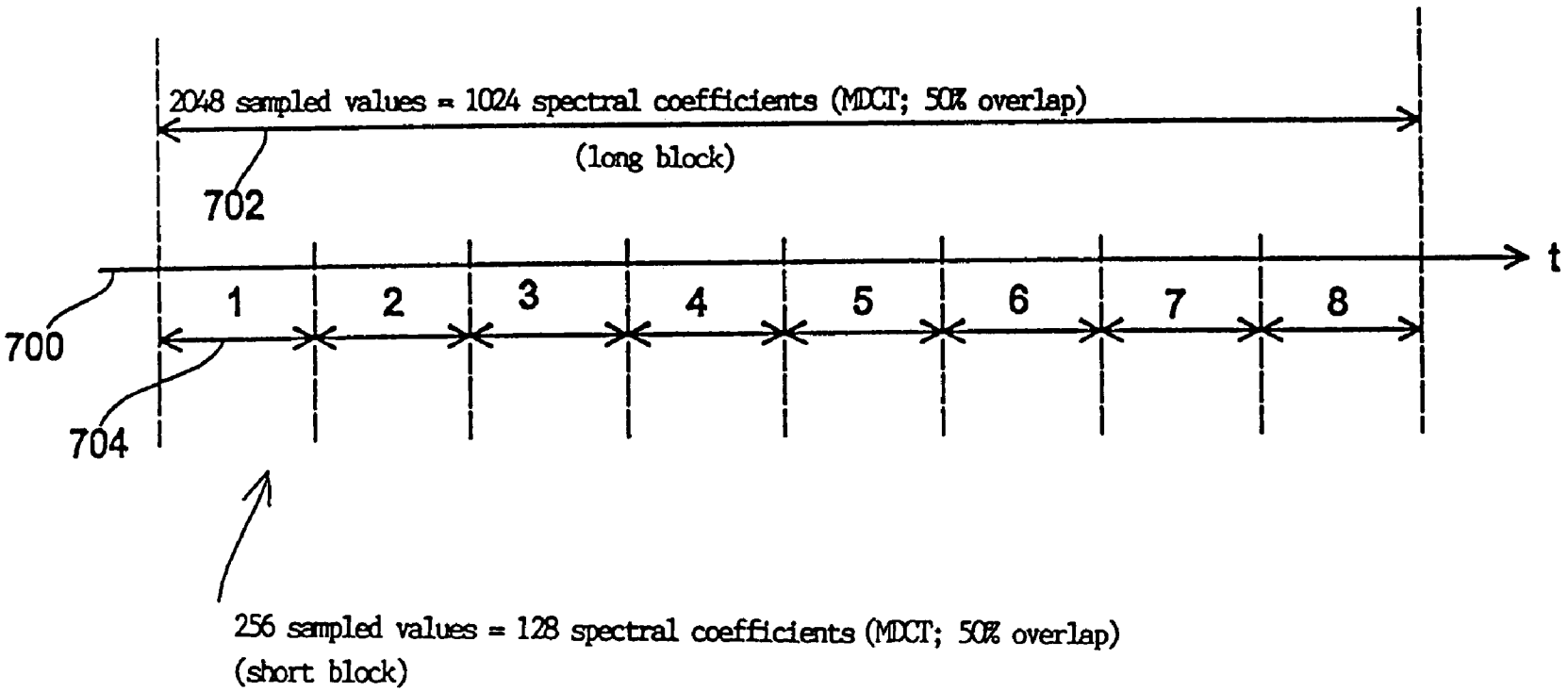
FIG. 7 shows a schematic representation of the block structure according to the AAC standard.

This property will now be illustrated further by making use of FIG. 7 to represent the situation for MPEG-2 AAC. FIG. 7 has a time axis 700 in terms of which the extent of a long block 702 is represented. A long block comprises 2048 sampled values, resulting in 1024 spectral coefficients if the windows overlap by 50% as is known. Background details of the modified discrete cosine transform (MDCT)] which is used and window over-lapping are to be found in the already cited standard. In FIG. 7 eight short blocks 704 are also depicted, each of which has 256 sampled values, again resulting in 128 spectral coefficients due to the 50% overlap. For reasons of clarity, the overlapping of the short blocks and the overlapping of the long block with a preceding long block or with a preceding or subsequent start or stop window have not been shown in FIG. 7. However, it is clear from FIG. 7 that the number of spectral coefficients in a long block is equal to eight times the number of spectral coefficients in a short block. Put another way, a long block encompasses the same time duration of the audio signal as do eight short blocks.

As is shown in FIG. 2, the reverse transform unit 502 is controlled via the block type line 508 in such a way that it performs eight successive reverse transforms of the spectral coefficients in the corresponding sub-bands of short blocks and arranges the resulting quasi time signals serially next to one another so as to provide the unit 504 for generating estimated values with a time signal of a certain length. As a counterpart to this, the forward transform unit 506 will also perform eight successive forward transforms on the values which are issued serially by the unit 504 for generating estimated values. This "operating cycle" thus ensures that in the case of short blocks the same number of spectral coefficients is output as in the case of long blocks. The spectral coefficients which are output by the error concealment unit 500 in an "operating cycle" are termed a set of estimated spectral coefficients in the sense of the present invention. On the grounds of practicability the number of spectral coefficients in a set is the same as the number of spectral coefficients in a long block and the number of spectral coefficients in eight short blocks. It is obvious that other ratios between long and short block can be chosen, e.g. 2, 4 or 16. Normally the situation will be such that the number of spectral coefficients in a long block will be divisible by the number of spectral coefficients in a short block. Should this not be so for some reason, however, the number of spectral coefficients in a set would be equal to the least common multiple of long and short blocks so as to achieve independence from the block type at the predictor level, i.e. in the unit 504 for generating estimated values.

Figure 3:
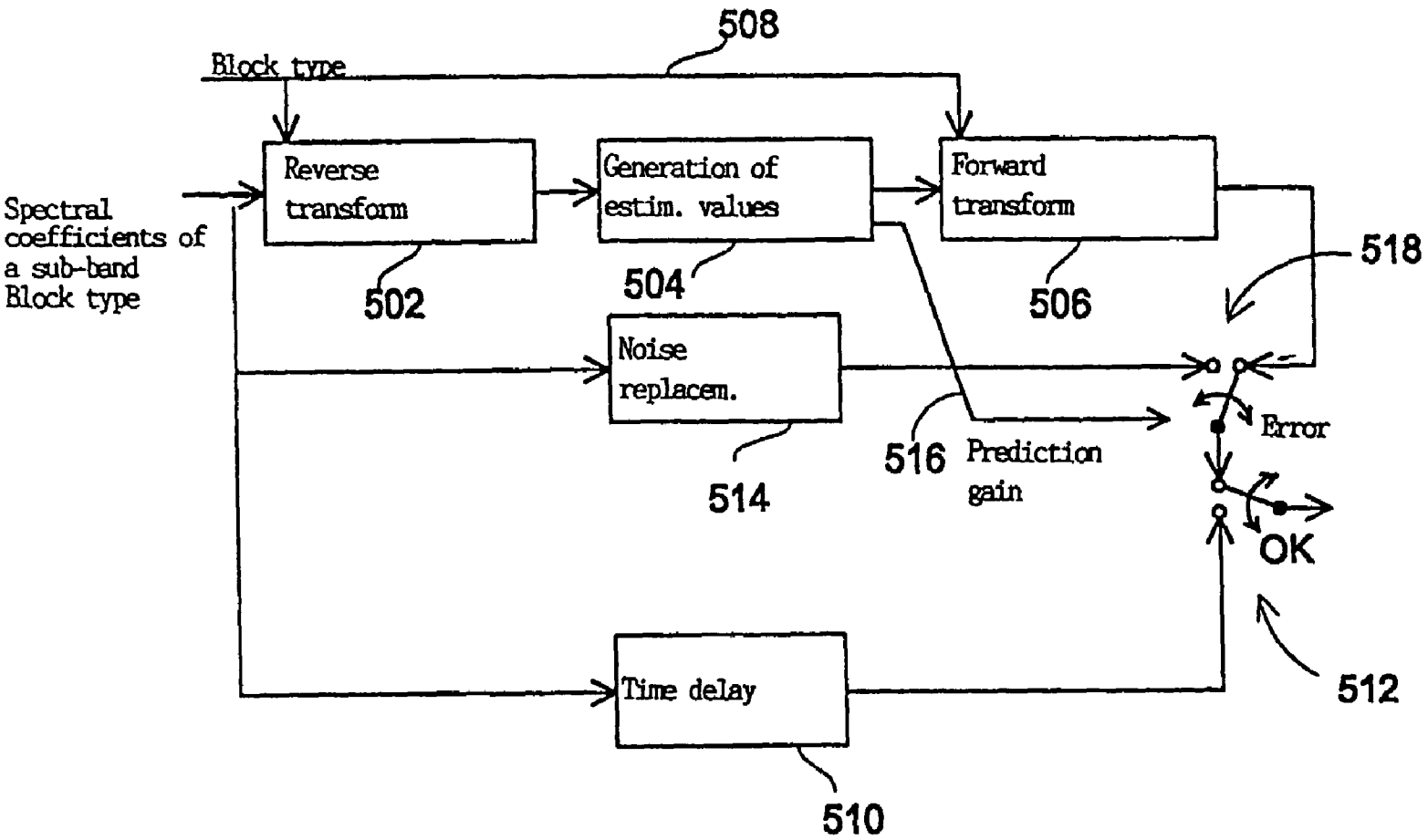
FIG. 3 shows a detailed block diagram of the error concealment unit of FIG. 1 which also provides noise substitution and which works according to the prediction gain.

FIG. 3, which represents a preferred development of the error concealment unit of FIG. 2, will now be considered. An important feature here is that the error concealment unit has been provided with a noise replacement unit 514 which, in place of the forward transform unit 506, can be connected to the error replacement unit via a noise replacement switch 518 depending on a prediction gain signal 516. The noise replacement unit 514 operates according to the method described in DE 197 35 675 A1 so as to approximate noisy signal content. Since noisy signal content is involved, the phase of the spectral coefficients is no longer considered but simply the energy of a number of spectral coefficients in a subgroup. Depending on the energy in a subgroup of the last intact audio data, the noise replacement unit 514 generates a corresponding subgroup of spectral coefficients, the energy in the subgroup of generated spectral coefficients equalling the energy of the corresponding subgroup of the preceding spectral coefficients or being derived from it. The phases of the spectral coefficients generated in the noise replacement process are, however, specified randomly.

The noise replacement switch 518 is controlled by a prediction gain signal 516. In general the prediction gain depends on the way the output signal of the unit 504 for generating estimated values relates to the input signal. If it is found that the output signal in a sub-band is substantially the same as the input signal, it can be assumed that the audio signal in this sub-band is relatively steady, i.e. tonal. If, on the other hand, the output signal of the predictor differs markedly from the input signal, it can be assumed that the audio signal in this sub-band is relatively unsteady, i.e. atonal or noisy. In this case a noise replacement will provide better results than a prediction since noisy signals cannot per se be reliably predicted. The noise replacement switch 518 could, for example, be so controlled that it connects the forward transform unit 506 to the error replacement unit 512 when the prediction gain exceeds a certain threshold and connects the noise replacement unit 514 to the error replacement unit 512 when the prediction gain does not exceed this threshold, thus combining the two substitution methods in an optimal way.

Figure 4:
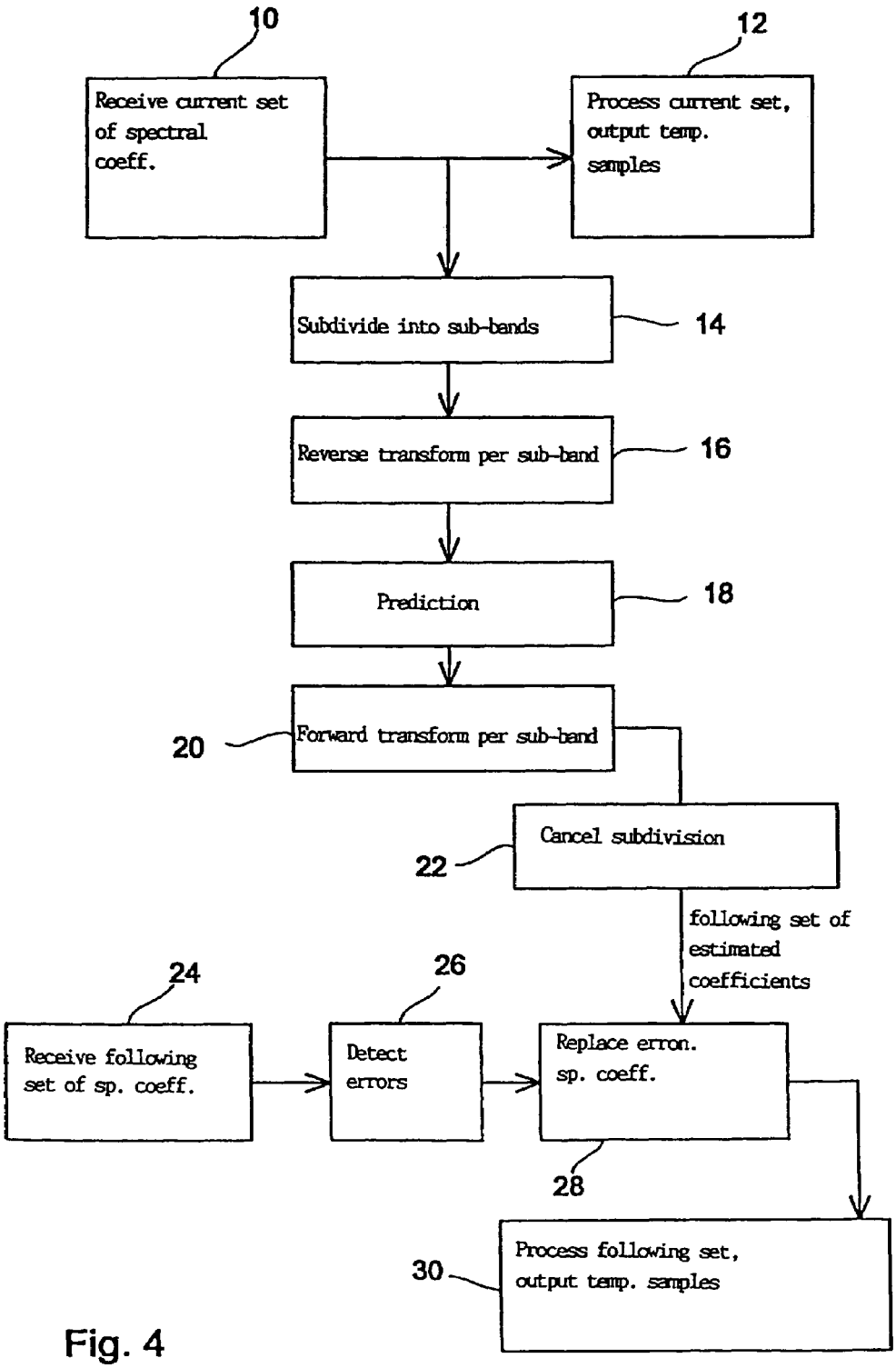
FIG. 4 shows a flowchart for the method for error concealment according to the present invention.

The method of noise substitution according to the present invention will now be considered in more detail making reference to FIG. 4. First, a current set of spectral coefficients is received (10)]. For reasons of clarity it is assumed in FIG. 4 that the current set of spectral coefficients consists entirely of intact spectral coefficients or has already been subjected to a error concealment method as shown in FIG. 2 or FIG. 3. On the one hand the current set of spectral coefficients is processed by the filter bank 400 (FIG. 1)] and output e.g. to a loudspeaker (12)]. On the other hand the current set of spectral coefficients is used to predict or estimate a subsequent set of spectral coefficients. To achieve this according to the present invention the current set of spectral coefficients is subdivided into sub-bands (14)]. In the case of a long block the subdivision into sub-bands is effected by generating just one sub-band with a corresponding frequency range for each set. In the case of short blocks the current set of spectral coefficients will consist of a plurality of successive complete spectra. Then, in step 14, corresponding sub-bands are generated for each complete spectrum, i.e. a plurality of sub-bands for each set of spectral coefficients.

After subdivision into sub-bands a reverse transform is per-formed for each sub-band (16)]. In the case of long blocks, where the number of spectral coefficients in a block is equal to the number of spectral coefficients in a set, a single reverse transform is performed for each sub-band prior to the prediction 18. In the case of short blocks several reverse transforms corresponding to the sub-bands of each "short" spectrum are performed before a prediction 18 is effected for all the sub-bands together.

The prediction 18 takes place in the quasi time domain, i.e. for each sub-band "time" signal, so as to obtain an estimated sub-band time signal for the subsequent set. This estimated quasi time signal is then subjected to a forward transform 20, again once only for a long block and N times for short blocks, N being the ratio of the number of spectral coefficients of a long block to the number of spectral coefficients of a short block.

After step 20 estimated spectral coefficients are available for each sub-band. In a step 22 the subdivision introduced in step 14 is revoked again so that a subsequent set of spectral coefficients is obtained after step 22.

In a step 24 the subsequent set of spectral coefficients is received by the decoder. This set undergoes error detection 26 in order to establish whether one spectral coefficient, several spectral coefficients or all spectral coefficients of the subsequent set are erroneous. The error detection is effected in a way which is known to persons skilled in the art, e.g. by checking the CRC checksum (CRC=Cyclic Redundancy Code)] over a block. If it is found that a checksum that is calculated on the basis of the transmitted data differs from the checksum transmitted with the data, the estimated spectral coefficients generated by step 22 can be adopted instead of the spectral coefficients of the erroneous block. The erroneous spectral coefficients are thus replaced by the estimated spectral coefficients (28)]. Finally the error-concealed spectral coefficients of the subsequent set are processed so as to be able to output the temporal sampled values (30)].

The flowchart of FIG. 4 essentially represents a snapshot of the processing which takes place from one set of spectral coefficients to the next set of spectral coefficients. If the flowchart of FIG. 4 is implemented it is obvious that e.g. only a single filter bank 400 (FIG. 1)] is used to perform the steps 12 and 30. Equally, it is obvious that only a single unit is needed to receive the current set of spectral coefficients and to receive the subsequent set of spectral coefficients to implement the steps 10 and 24. Temporal synchronicity for the steps 10 and 24 in a device which implements the method according to the present invention is ensured by the time delay stage 510 in the parallel branch (FIG. 2)].

Figure 5:
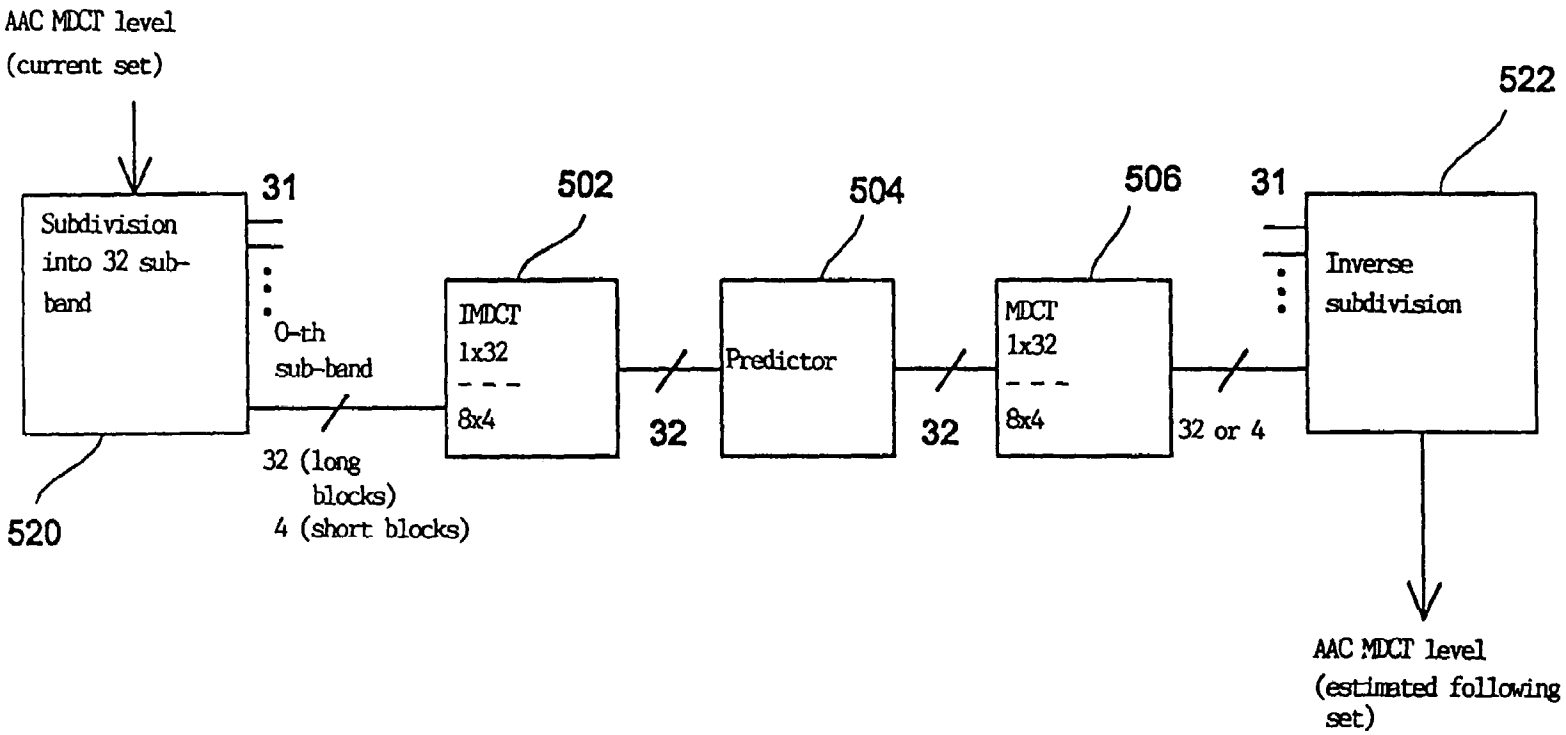
FIG. 5 shows a detailed block diagram of a preferred embodiment of the error concealment unit for an MPEG-2 AAC decoder.

FIG. 5 shows a more detailed representation of the general block diagram of FIG. 2 for the example of an MPEG-2 AAC transform encoder featuring the error concealment unit 500 according to the present invention. As has already been explained with reference to FIG. 2, the error concealment unit 500 (FIG. 1)] includes a unit 520 for subdividing the blocks of spectral coefficients into, preferably, 32 sub-bands. In the case of long blocks each sub-band has 32 spectral coefficients. Since the sub-bands of the short blocks span the same frequency range, each sub-band has 4 spectral coefficients in the case of short blocks. A subdivision of a complete spectrum into sub-bands of the same size is preferred on the grounds of simplicity, though a subdivision into unequal sub-bands would also be possible, e.g. to reflect the psychoacoustical frequency groups. Each sub-band is then subjected to an inverse modified discrete cosine transform. In the case of long blocks the IMDCT is performed once and receives 32 input values. In the case of short blocks eight successive IMDCTs are per-formed, each with 4 of the spectral coefficients, so that 32 quasi time sampled values again result at the output. These are then passed on to the predictor 504, which in turn generates 32 estimated quasi time sampled values which are transformed by the MDCT 506. In the case of long blocks a single MDCT is performed with 32 temporal values, whereas in the case of short blocks eight successive MDCTs are performed, each having 4 sampled values. Although only one branch for the 0-th sub-band is shown in FIG. 5, it should be noted that an identical branch exists for each sub-band if all the sub-bands are of the same length. If the sub-bands are of different lengths, the orders of the IMDCT or MDCT are adapted accordingly. For the purposes of a practical implementation an obvious choice is parallel processing. Obviously, however, serial processing of the sub-bands is also possible, if sufficient storage capacity is available. The output values of the MDCT 506 for each sub-band are fed to a unit 522 for reversing the subdivision, i.e. into an inverse subdivision unit, so as to output an estimated set of spectral values for the preferred embodiment at the AAC MDCT level.

Figure 6:
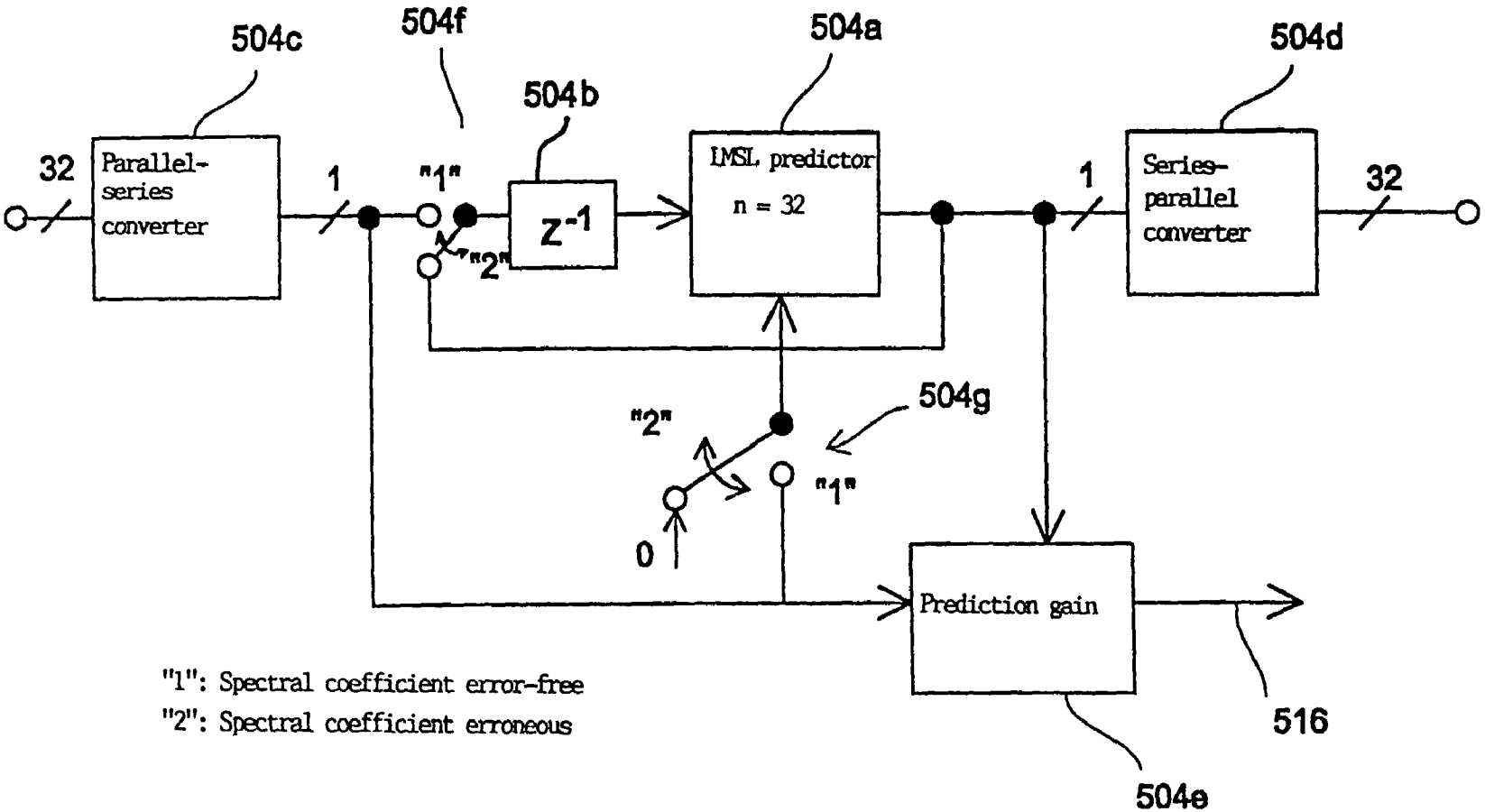
FIG. 6 shows a detailed block diagram of the predictor of FIG. 5.

FIG. 6 shows a further detailed representation of the predictor 504. The heart of the predictor 504 in the preferred embodiment is a so-called LMSL predictor 504*a* with a length of n=32. Details of the LMSL predictor can be found in the book "Adaptive Signal Processing", Bernard Widrow, Samuel Stearns, Prentice-Hall, 1995, p. 99 ff. The LMSL predictor 504*a* is pre-ceded by a time delay stage 504*b*. The predictor 504 also includes a parallel-series converter 504*c* on the input side and a series-parallel converter 504*d* on the output side. It also has a prediction gain calculator 504*e* which compares the out-put signal of the predictor 504*a* with the input signal in order to establish whether a steady signal or an unsteady signal has been processed. On the output side the prediction gain calculator 504*e* supplies the prediction gain signal 516, which is used to control the switch 518 (FIG. 3)] so as to employ either predicted spectral coefficients or spectral coefficients gained by noise substitution for the purposes of error concealment. In its implementation as LMSL predictor the predictor 504 also includes two switches 504*f* and 504*g*, which have two switch settings. The switch setting "1" applies when the spectral coefficients of the subsequent block are error-free and the switch setting "2" applies when the spectral coefficients of the subsequent set are erroneous. FIG. 6 shows the case where the spectral coefficients are erroneous. In this case a reference signal with a value of 0 is fed into the predictor at the switch 504*g* instead of the input signal. In the case of error-free spectral coefficients (switch setting "1" of the switch 504*g*)], on the other hand, the output values of the parallel-series converter are fed into the LMSL predictor from below.

If the error concealment method according to the present invention is used in connection with an AAC encoder, the preferred option is to use the corresponding transform algorithms (MDCT or IMDCT)] for all the forward and reverse transforms.

For error concealment it is not, however, necessary that the same transform method is employed for the reverse or forward transform as was used when encoding the audio signal to form the spectral coefficients.

Due to the subdivision of the spectrum into sub-bands and due to the individual transforms for each sub-band, frequency-time domain transforms of lower order than the frequency resolution are used appropriately for each sub-band. As a result special estimated values for tonal signal portions are generated in the intermediate level by means of the predictor. Time-frequency domain transforms of lower order than the original frequency resolution are used appropriately as forward transform/synthesis, the same order being chosen as for the frequency-time domain transform which is used. Thus error concealment according to the present invention provides flexibility through using advance knowledge of the spectral properties of audio signals and also independence from the transform method used in the encoder through the generation of estimated values in the quasi time signal, i.e. not at the spectral coefficient level. If the prediction in the quasi time domain is used to replace tonal signal portions and if the noise replacement is used for noisy spectral portions, errors for a large class of audio signals can be concealed to such an extent that, even in the case of complete block loss, there is practically no audible disturbance. Trials have shown that, for not too critical test signals, normal listeners, i.e. untrained test listeners, have heard irregularities in the audio signal only in one case out of 10 even when there has been complete block loss.

What is claimed is:

1. A method for concealing an error in an encoded audio signal, where the encoded audio signal has successive sets of spectral coefficients, where a set of spectral coefficients is a spectral representation for a set of audio sampled values, comprising the following steps:

subdividing a current set of spectral coefficients into at least two sub-bands with different frequency ranges, where one sub-band of the at least two sub-bands has at least two spectral coefficients;

reverse transforming the spectral coefficients of the one sub-band to obtain a temporal representation of the at least two spectral coefficients of the one sub-band;

performing a prediction using the temporal representation of the at least two spectral coefficients of the one sub-band to obtain an estimated temporal representation for a sub-band of a set following the current set, where the sub-band of the following set has the same frequency range as the sub-band of the current set;

forward transforming the estimated temporal representation to obtain at least two estimated spectral coefficients for the sub-band of the following set;

determining whether a spectral coefficient of the sub-band of the following set is erroneous; and as reaction to the step of determining, if there is an erroneous spectral coefficient, using an estimated spectral coefficient instead of an erroneous spectral coefficient of the following set so as to conceal the erroneous spectral coefficient of the following set.

2. A method according to claim 1, wherein the one sub-band that is processed in the step of reverse transforming has low-frequency spectral coefficients and the other of the at least two sub-bands has higher-frequency spectral coefficients.

3. A method according to claim 1, wherein the number of spectral coefficients in a set of spectral coefficients is equal to the number of spectral coefficients in a block of the first length and is N times the number of spectral coefficients in a block of the second length, and wherein N blocks of the second length follow each other, where the step of subdividing is performed in such a way that the sub-bands of the blocks of the first length have the same frequency ranges as the sub-bands of the blocks of the second length, so that the number of spectral coefficients of a sub-band of the block of the first length is equal to N times the number of spectral coefficients of the corresponding sub-band of the block of the second length;

the step of reverse transforming is performed in succession for each corresponding sub-band of the N blocks of the second length to obtain a temporal representation of the spectral coefficients of the corresponding sub-bands of the N blocks of the second length;

the step of performing a prediction is effected with the temporal representation of all the corresponding sub-bands of the N blocks of the second length; and the step of forward transforming is performed successively for each corresponding sub-band of the N blocks of the second length.

4. A method according to claim 1, wherein a plurality of sub-bands is generated in the step of subdividing such that all the sub-bands together form the spectral representation of the encoded audio signal in a set of spectral coefficients.

5. A method according to claim 1, wherein the following step is performed after the step of determining whether a spectral coefficient of a sub-band is erroneous:

determining whether the spectral coefficient represents a tonal portion of the uncoded audio signal by comparing the spectral coefficient with the corresponding estimated spectral coefficient;

if the spectral coefficient is found to be tonal, using the estimated spectral coefficient, and, if the spectral coefficient is found to be non-tonal, performing a noise substitution for an erroneous spectral coefficient of the following set.

6. A method according to claim 3, wherein the spectral coefficients are MDCT coefficients, the length of a set corresponds to the length of a long block and has 1024 MDCT coefficients, while a set of spectral coefficients comprises eight short-length blocks, each with 128 MDCT coefficients, and wherein 32 sub-bands, each with 32 MDCT coefficients for a long block or each with 4 MDCT coefficients for a short block, are formed in the step of subdividing.

7. A method according to claim 1, wherein an adaptive back-coupled predictor, preferably an LMSL predictor, is used in the step of performing the prediction.

8. A method according to claim 1, wherein the transform algorithm which forms the basis of the encoded audio signal is the same transform algorithm that is used in the step of reverse transforming and in the step of forward transforming.

9. A method according to claim 1, wherein the transform algorithm which is used in the step of reverse transforming is the exact inverse of the transform algorithm that is used in the step of forward transforming.

10. A method for decoding an encoded audio signal which comprises successive sets of spectral coefficients, wherein a set of spectral coefficients is a spectral representation for a set of audio sampled values:

receiving a current set of spectral coefficients;

subdividing a current set of spectral coefficients into at least two sub-bands with different frequency ranges, where one sub-band of the at least two sub-bands has at least two spectral coefficients;

reverse transforming the spectral coefficients of the one sub-band to obtain a temporal representation of the at least two spectral coefficients of the one sub-band;

performing a prediction using the temporal representation of the at least two spectral coefficients of the one sub-band to obtain an estimated temporal representation for a sub-band of a set following the current set, where the sub-band of the following set has the same frequency range as the sub-band of the current set;

forward transforming the estimated temporal representation to obtain at least two estimated spectral coefficients for the sub-band of the following set;

receiving a following set of spectral coefficients and subdividing the following set into sub-bands which cover the same frequency range as the sub-bands of the current set;

determining whether a spectral coefficient of the sub-band of the following set is erroneous;

as reaction to the step of determining, if there is an erroneous spectral coefficient, using an estimated spectral coefficient instead of an erroneous spectral coefficient of the following set so as to conceal the erroneous spectral coefficient of the following set; and processing the following set using the estimated spectral coefficient used in the step of using to obtain the following set of audio sampled values.

11. A method according to claim 10, wherein the spectral coefficients of the encoded audio signal are entropy-coded and quantized, which includes the following steps before the step of receiving the current set or the following set:

cancelling the entropy coding to obtain quantized spectral coefficients;

requantizing the quantized spectral coefficients to obtain requantized spectral coefficients;

and wherein the step of processing includes the following step:

reverse transforming the following set using a transform algorithm which is inverse to the transform algorithm used for transforming to obtain the spectral coefficients of the encoded audio signal.

12. A device for concealing an error in an encoded audio signal, where the encoded audio signal has successive sets of spectral coefficients, where a set of spectral coefficients is a spectral representation for a set of audio sampled values, with the following features:

a unit for subdividing a current set of spectral coefficients into at least two sub-bands with different frequency ranges, where one sub-band of the at least two sub-bands has at least two spectral coefficients;

a unit for reverse transforming the spectral coefficients of the one sub-band to obtain a temporal representation of the at least two spectral coefficients of the one sub-band;

a unit for performing a prediction using the temporal representation of the at least two spectral coefficients of the one sub-band to obtain an estimated temporal representation for a sub-band of a set following the current set, where the sub-band of the following set has the same frequency range as the sub-band of the current set;

a unit for forward transforming the estimated temporal representation to obtain at least two estimated spectral coefficients for the sub-band of the following set;

a unit for determining whether a spectral coefficient of the sub-band of the following set is erroneous; and a unit for using an estimated spectral coefficient instead of an erroneous spectral coefficient of the following set so as to conceal the erroneous spectral coefficient of the following set.

13. A device for decoding an encoded audio signal which comprises successive sets of spectral coefficients, where a set of spectral coefficients is a spectral representation for a set of audio sampled values:

a unit for receiving a current set of spectral coefficients;

a unit for subdividing a current set of spectral coefficients into at least two sub-bands with different frequency ranges, where one sub-band of the at least two sub-bands has at least two spectral coefficients;

a unit for reverse transforming the spectral coefficients of the one sub-band to obtain a temporal representation of the at least two spectral coefficients of the one sub-band;

a unit for performing a prediction using the temporal representation of the at least two spectral coefficients of the one sub-band to obtain an estimated temporal representation for a sub-band of a set following the current set, where the sub-band of the following set has the same frequency range as the sub-band of the current set;

a unit for forward transforming the estimated temporal representation to obtain at least two estimated spectral coefficients for the sub-band of the following set;

a unit for receiving a following set of spectral coefficients and for subdividing the following set into sub-bands which cover the same frequency range as the sub-bands of the current set;

a unit for determining whether a spectral coefficient of the sub-band of the following set is erroneous;

a unit for using an estimated spectral coefficient instead of an erroneous spectral coefficient of the following set so as to conceal the erroneous spectral coefficient of the following set; and a unit for processing the following set using the estimated spectral coefficient to obtain the following set of audio sampled values.

* * * * *